US012716315B2

(12) United States Patent
Holderman et al.

(10) Patent No.: US 12,716,315 B2
(45) Date of Patent: Aug. 25, 2026

(54) EXPANDABLE PACKER WITH ACTIVATABLE SEALING ELEMENT

(71) Applicant: Halliburton Energy Services, Inc., Houston, TX (US)

(72) Inventors: Luke William Holderman, Dallas, TX (US); Rutger Evers, Singapore (SG); Brandon Thomas Least, Flower Mound, TX (US); Michael Linley Fripp, Carrollton, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/240,186

(22) Filed: Apr. 26, 2021

(65) Prior Publication Data

US 2022/0341280 A1 Oct. 27, 2022

(51) Int. Cl.
*E21B 33/12* (2006.01)
*E21B 34/14* (2006.01)

(52) U.S. Cl.
CPC ..... *E21B 33/1208* (2013.01); *E21B 34/14* (2013.01)

(58) Field of Classification Search
CPC ... E21B 34/14; E21B 33/1208; E21B 33/1212
See application file for complete search history.

(56) References Cited

U.S. PATENT DOCUMENTS 3,616,354 A 10/1971 Russell
6,581,682 B1 * 6/2003 Parent ..... E21B 33/1243 166/119
7,866,408 B2 1/2011 Allison et al.
8,453,750 B2 6/2013 Solhaug et al.
(Continued)

FOREIGN PATENT DOCUMENTS

CN 105948639 B * 5/2018 ..... C04B 20/0076
EP 0940558 A1 9/1999
(Continued)

OTHER PUBLICATIONS

International Search Report and Written Opinion mailed on Jan. 5, 2022 for corresponding PCT Application No. PCT/US2021/029524 filed on Apr. 28, 2021.
(Continued)

*Primary Examiner* — Theodore N Yao

(57) ABSTRACT

An expandable packer includes an activatable sealing element locatable in a borehole having a wall and activatable with a reactive fluid. The sealing element includes a swellable metal capable of reacting with the reactive fluid to form a swelled metal and a mechanical element separating the reactive fluid from the swellable metal and operable to cause the reactive fluid to contact the swellable metal such that swellable metal expands into sealing engagement with the wall. A method of forming a seal in a borehole comprising a wall includes locating an expandable packer comprising an activatable sealing element within the borehole, using a mechanical element of the activatable sealing ele-
(Continued)

ment to cause a reactive fluid to contact a swellable metal, and expanding the swellable metal into sealing engagement with the wall by reacting the swellable metal with the reactive fluid.

10 Claims, 9 Drawing Sheets

(56) References Cited

U.S. PATENT DOCUMENTS

| | | | | |
|---|---|---|---|---|
| 10,913,885 | B1 | 2/2021 | Fripp et al. | |
| 10,961,804 | B1 | 3/2021 | Fripp et al. | |
| 2004/0194970 | A1 | 10/2004 | Eatwell | |
| 2007/0151724 | A1 | 7/2007 | Ohmer et al. | |
| 2008/0110626 | A1* | 5/2008 | Allison | E21B 33/127 166/288 |
| 2008/0135249 | A1 | 6/2008 | Fripp | |
| 2008/0149351 | A1 | 6/2008 | Marya et al. | |
| 2009/0139707 | A1* | 6/2009 | Berzin | E21B 33/1216 29/428 |
| 2009/0218107 | A1* | 9/2009 | Chauffe | E21B 33/1208 166/387 |
| 2010/0139930 | A1* | 6/2010 | Patel | E21B 33/1208 166/387 |
| 2011/0098202 | A1* | 4/2011 | James | C09K 8/5086 507/221 |
| 2011/0315405 | A1* | 12/2011 | Solhaug | E21B 33/1208 166/387 |
| 2012/0261127 | A1 | 10/2012 | Zhou | |
| 2013/0048288 | A1 | 2/2013 | Mazyar et al. | |
| 2013/0048289 | A1 | 2/2013 | Mazyar et al. | |
| 2013/0056209 | A1 | 3/2013 | Mazyar et al. | |
| 2013/0081815 | A1 | 4/2013 | Mazyar et al. | |
| 2016/0138559 | A1 | 5/2016 | Bauer | |
| 2016/0145968 | A1 | 5/2016 | Marya | |
| 2018/0078998 | A1 | 3/2018 | Sherman | |
| 2018/0087350 | A1* | 3/2018 | Sherman | C08K 3/08 |
| 2018/0100367 | A1 | 4/2018 | Perez | |
| 2018/0347288 | A1 | 12/2018 | Fripp | |
| 2019/0048680 | A1* | 2/2019 | Stein | E21B 33/1208 |
| 2020/0056435 | A1 | 2/2020 | Sherman | |
| 2020/0240235 | A1 | 7/2020 | Fripp et al. | |
| 2020/0325749 | A1 | 10/2020 | Fripp et al. | |
| 2020/0362224 | A1 | 11/2020 | Wellhoefer et al. | |
| 2020/0370391 | A1 | 11/2020 | Fripp et al. | |

FOREIGN PATENT DOCUMENTS

| | | | |
|---|---|---|---|
| WO | 2014028149 | A1 | 2/2014 |
| WO | 2015057338 | A1 | 4/2015 |
| WO | 2015099909 | A1 | 7/2015 |
| WO | 2018085102 | A1 | 5/2018 |
| WO | 2019094044 | A1 | 5/2019 |
| WO | 2019164492 | A1 | 8/2019 |
| WO | 2020018110 | A1 | 1/2020 |
| WO | 2020068037 | A1 | 4/2020 |
| WO | 2019164499 | A8 | 8/2020 |
| WO | 2020171825 | A1 | 8/2020 |
| WO | 2021011013 | A1 | 1/2021 |
| WO | 2021034325 | A1 | 2/2021 |

OTHER PUBLICATIONS

Fripp, Michael et al. "Novel Expanding Metal Alloy for Non-Elastomeric Sealing and Anchoring" Paper presented at the SPE Annual Technical Conference and Exhibition, Houston, Texas, USA, Oct. 2022. https://doi.org/10.2118/210273-MS; Paper No. SPE-210273-MS.

Merchant B. Gold, The noble metal and the paradoxes of its toxicology, Biologicals. Mar. 1998; 26 (1); 49-59. Doi; 10.1006/biol.1997.0123. PMID: 9637749 (Year: 1998).

Fripp, Michael and Walton,Zachary, "Degradable Metal for Use in a Fully Dissolvable Frac Plug." Paper presented at the Offshore Technology Conference, Houston, TX USA, May 2016, doi: https://doi.org/10.4043/27187-MS (2016).

* cited by examiner

EXPANDABLE PACKER WITH ACTIVATABLE SEALING ELEMENT

BACKGROUND

This section is intended to provide relevant background information to facilitate a better understanding of the various aspects of the described embodiments. Accordingly, these statements are to be read in this light and not as admissions of prior art.

Throughout the life of a hydrocarbon-producing well, fluid flow inside or around various tubulars disposed in a borehole may need to be controlled or prevented in various locations at various times. For example, the annulus between a formation or casing wall and production tubing may require a seal to isolate sections of the annulus.

Expandable packers may be used, among other reasons, to form such annular seals downhole. The annular seals may partially or fully restrict fluid and/or pressure communication at the seal interface. The seals may also be formed during all stages of drilling, completion, and production.

An expandable packer operates by expanding when contacted with a reactive fluid. Activation of expandable packers is typically sensitive to the downhole environment and conditions, such as time to run tubing in hole, reactivity of swellable material with fluids flowing into or out of the borehole, and downhole temperature and pressure. Since the expandable packer expands upon contacting ionic water, the borehole must be kept free of ionic water until expansion is desired. Additionally, operations targeting isolated zones of the borehole must wait until the expandable packer has fully expanded and formed the zonal seal. Expandable packers thus require undesirable cessation of drilling and other operations while setting the packer downhole. A need exists for an expandable packer that can be activated on command to form the annular seal regardless of downhole or other conditions.

BRIEF DESCRIPTION OF THE DRAWINGS

Embodiments of an expandable packer with an activatable sealing element are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness. Alternatives and additional elements not shown may nevertheless be within the scope of the embodiments described below.

DETAILED DESCRIPTION

Figure 1:
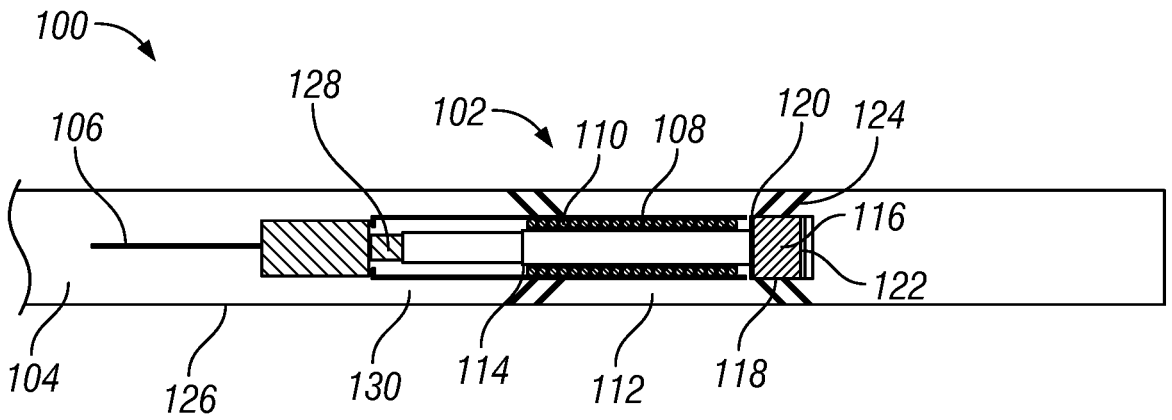
FIG. 1 is a schematic diagram of a cross-section view of an expandable packer comprising an activatable sealing element in a pre-activation configuration, according to a first embodiment.

The present disclosure describes an expandable packer with an activatable sealing element for forming a seal in a borehole and a method therefor. The expandable packer is locatable in the borehole and the activatable sealing element comprises a swellable metal capable of reacting to form a swelled metal. The activatable sealing element also includes a reactive fluid separated from the swellable metal and a mechanical element operable to cause the reactive fluid to contact the swellable metal and expand the swelled metal radially from the activatable sealing element into sealing engagement with a wall in the borehole. When contacted, the reactive fluid and swellable metal react via hydrolysis.

The swellable metal can suitably be any metal that can hydrolyze when reacted with the reactive fluid to form a swelled metal hydroxide or swelled metal oxide that is insoluble in water and is expanded in volume compared to the reactants. The swellable metal may comprise an alkaline earth metal, a transition metal, a post-transition metal, or a combination thereof. The swellable metal may comprise magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or combinations thereof, preferably magnesium, calcium, aluminum, or combinations thereof. The swellable metal may comprise an alloy to promote reactivity or control formation of metal oxides and hydroxides, such an alloy including, for example, magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, and combinations thereof. The swellable metal can be alloyed with a dopant to promote corrosion, for example, nickel, iron, copper, cobalt, carbon, tungsten, tin, gallium, bismuth, or combinations thereof. An alloy can additionally include, for example, non-metallic components such as graphite, carbon, silicon, boron nitride, and the like. The swellable metal may be prepared in a solid solution process with molten metal or with a powder metallurgy process. Heat treatments can additionally be performed to change grain size of the particles such as through annealing, solution treating, aging, quenching, and hardening.

The swellable metal is preferably provided in the form of a high surface area swellable metal. The high surface area metal may be in the shape of beads, power, wires, pellets, particles, granules, the like, or combinations thereof. The high surface area swellable metal has a surface-area-to-volume ratio up to 100 $m^{-1}$, exposing surfaces of the high surface area swellable metal to the reactive fluid to speed the reaction. As the surface-area-to-volume ratio is increased, the reaction proceeds more quickly. After the reaction has begun, the high surface area swellable metal expands to contact the wall and forms a seal thereon in less than about 24 hours. Depending on the reactants, the reaction can be exothermic and can produce hydrogen gas as a by-product.

A hydrostatic chamber may be included in the expandable packer to contain and isolate the swellable metal. The hydrostatic chamber can include a non-reactive gas or a non-reactive liquid. Suitable non-reactive gases include air, carbon dioxide, nitrogen, hydrogen, and argon. Suitable non-reactive liquids include hydrocarbons, alcohols, oils, silicone oils, oil-based muds, distilled water, and the like.

The reactive fluid includes any fluid suitable to react with and hydrolyze the swellable metal to form a swelled metal. The reactive fluid may comprise an aqueous fluid, such as ionic or non-ionic fresh water, or brine containing salts such as sodium chloride, sodium bromide, potassium chloride, potassium bromide, magnesium chloride, calcium chloride, calcium bromide, and the like, for example. The brine can be monovalent or divalent and can comprise saltwater, saturated saltwater, seawater, or any combination thereof. The brine can have high salinity, for example, in excess of 10 wt %. The reactivity of the swellable metal with high-salinity brines provides an advantage over elastomeric sealing elements whose sealing performance may be impacted by such brines.

The activatable sealing element is activated by selectively operating a mechanical element to cause the reactive fluid to contact the swellable metal. The mechanical element may include a downhole power unit, a control line, a piston, or a firing pin, according to various embodiments. The mechanical element may be selectively operated in any suitable way, including by timer, pressure, temperature, pH, or vibration. Such operation can include commands from human operators or equipment at the surface or downhole. Selective operation of the mechanical element and activation of the activatable sealing element may also include release of the reactive fluid within a control line to contact the swellable metal, or alternatively can include pumping of the reactive fluid contained either downhole or at the surface with a pump to the activatable sealing element.

The expandable packer may also include a downhole power unit to set the expandable packer. The downhole power unit may include an adapter kit suitable to set the expandable packer and activatable sealing element on coiled tubing, drill pipe, wireline, slickline, or the like. The downhole power unit may optionally be the mechanical element selectively operable to activate the activatable sealing element. Selective activation with the downhole power unit is described below with reference to the first embodiment and FIGS. 1-3, for example, but is not limited solely to that embodiment.

Activation of the activatable sealing element is selective and is independent of downhole conditions. The expandable packer and activatable sealing element can withstand downhole conditions such as high temperature and high pressure without reacting or otherwise expanding the swellable metal. The separation of the reactive fluid and swellable metal prevents inadvertent or premature swelling without selected operation of the mechanical element. Furthermore, the expandable packer and activatable sealing element can encounter external fluids without activating. For instance, a second reactive fluid can be contacted with the exterior of the activatable sealing element without operating the mechanical element or contacting the swellable metal. The expandable packer and activatable sealing element can remain downhole for extended periods of time with minimal to no expansion of the swellable metal. Thus, the expandable packer and activatable sealing element do not require inclusion nor exclusion of certain fluids downhole to retain functionality. Furthermore, operators can install the expandable packer downhole safely without concern for timing of expansion or suspending drilling operations.

The activatable sealing element may include a cover sleeve or outer sleeve suitable to protect the swellable metal from borehole conditions such as fluid flow, debris, high temperature, high pressure, and the like. The cover sleeve or outer sleeve is removable upon activation of the activatable sealing element to allow expansion of the swelled metal into the annular space and into sealing engagement with the wall. The cover sleeve or outer sleeve can comprise a degradable or dissolvable material including thermoplastics, metals, alloys, or combinations thereof to allow removal of the cover sleeve without reliance on mechanical, electronic, or other removal mechanisms. Suitable thermoplastics include aliphatic polyester, polyglycolic acids (PGAs), polylactic acids (PLAs), thiol, polyurethane, thermoplastic urethane, or combinations thereof. Suitable metals and alloys thereof include magnesium, calcium, aluminum, iron, nickel, copper, chromium, tin, zinc, lead, beryllium, gold, silver, lithium, sodium, potassium, rubidium, cesium, strontium, barium, gallium, indium, thallium, bismuth, scandium, titanium, vanadium, manganese, cobalt, yttrium, zirconium, niobium, molybdenum, ruthenium, rhodium, palladium, praseodymium, lanthanum, hafnium, tantalum, tungsten, terbium, rhenium, osmium, iridium, platinum, neodymium, gadolinium, erbium, or combinations thereof, preferably magnesium, calcium, aluminum, or combinations thereof. Where the cover sleeve comprises the same material as the swellable metal, the cover sleeve can similarly react with the reactive fluid and join the swelled metal to expand into sealing engagement with the wall.

The term "swellable" in reference to the "swellable metal" indicates a metal capable of undergoing a chemical reaction to form a swelled metal reaction product having greater volume than the swellable metal reactant.

A "wall" against which the swelled metal expands into sealing engagement can refer to a borehole wall, a cased hole wall, an open hole wall, a tubular wall, or a downhole tool wall.

The activatable sealing element comprises a pre-activation configuration, a post-activation configuration, and a sealing configuration. Turning now to the figures, FIGS. 1, 4, 5, 8, and 10 show embodiments of the pre-activation configuration, FIGS. 2, 6, 9, and 11 show embodiments of the post-activation configuration, and FIGS. 3, 7, and 12 show embodiments of the sealing configuration.

FIG. 1 shows a first embodiment of an expandable packer 100 comprising an activatable sealing element 102 according to the pre-activation configuration. In this configuration, the swellable metal 110 and the reactive fluid 116 are separated from one another. The swellable metal 110 is contained within a hydrostatic chamber formed by a cover sleeve 108 and an inner sleeve 114.

The reactive fluid 116 is contained in an openable container 118 that includes at least one mechanical element 120. The mechanical element 120 can comprise a gate, a port, or an openable valve, such as a rupture disk, which restricts or prevents flow of the reactive fluid 116 into contact with the swellable metal 110. In the pre-activation configuration shown in FIG. 1, the mechanical element 120 is blocked or closed to contain the reactive fluid 116 within the openable container 118. The openable container 118 can optionally include a piston 122 to push the reactive fluid 116 through the mechanical element 120 and out of the openable container 118. After exiting the openable container 118, the reactive fluid 116 can flow directly into the hydrostatic chamber, or as shown in FIG. 2, the reactive fluid 116 can flow into the annular space 112 and then into the hydrostatic chamber to contact the swellable metal 110.

The activatable sealing element 102 may also include wiper plugs 124, such as cup packers 124 and wiper fins 124, to at least partially seal an annular space 112. The annular space 112 is a subset of the annulus 130 with boundaries defined by the wiper plugs 124, cover sleeve 108, the wall 126, and the openable container 118. Some of the wiper plugs 124 are positioned between the cover sleeve 108 and the wall 126. The remaining wiper plugs 124 are positioned between the openable container 118 and the wall 126. The wall 126 can be a borehole wall 126 as shown in FIGS. 1-3 and can be lined, such as with a casing to provide a cased hole wall 126, or can be unlined to provide an open hole wall 126. Alternatively, the wall 126 can be a tubular wall 126 or a downhole tool wall 126. The wiper plugs 124 can be positioned against the wall 126. The wiper plugs 124 are biased outward as shown in FIGS. 1-3, allowing them to resist pressure in either direction and contain fluids in the annulus 130 inside or outside the annular space 112. The wiper plugs 124 are selectively permeable to contain the swellable metal 110 and the reactive fluid 116 within the annular space 112. However, the wiper plugs 124 allow some gases such as hydrogen, for example, to vent past the wiper plugs 124 and escape the annular space 112. The wiper plugs 124 thus guide formation of the annular seal and vent hydrogen by-product. The orientation of the wiper plugs 124 may also be the opposite direction from what is drawn in FIG. 1.

The expandable packer 100 and activatable sealing element 102 are also locatable in a borehole 104 about a conveyance 106. The expandable packer 100 and activatable sealing element 102 can form annular seals in tube or wire conveyance applications. The conveyance 106 can thus be a tubular 106, such as a coiled tube 106 or drill pipe 106. Alternatively, the conveyance 106 can be a wireline 106 or slickline 106.

Figure 2:
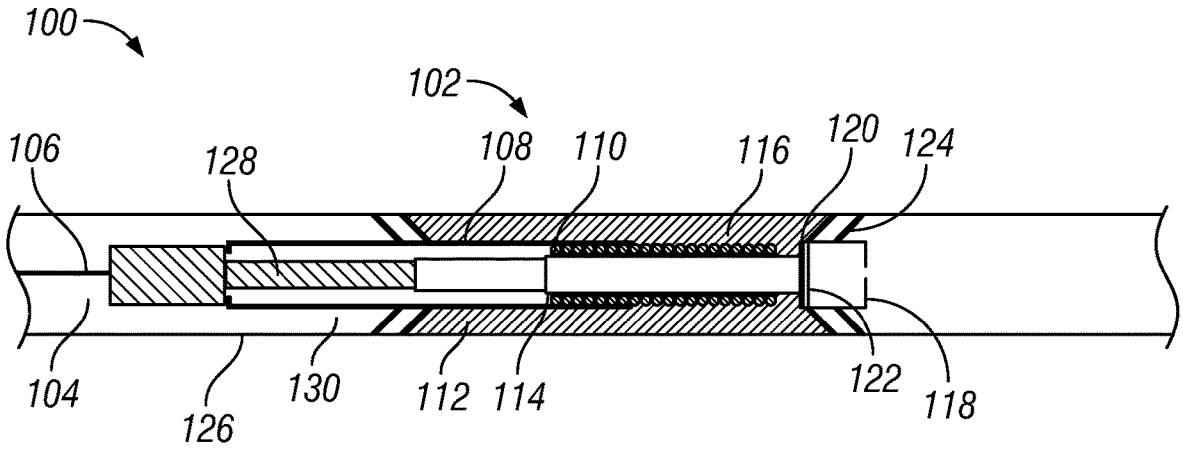
FIG. 2 is a schematic diagram of a cross-section view of the expandable packer of FIG. 1 in a post-activation configuration, according to the first embodiment.
Figure 3:
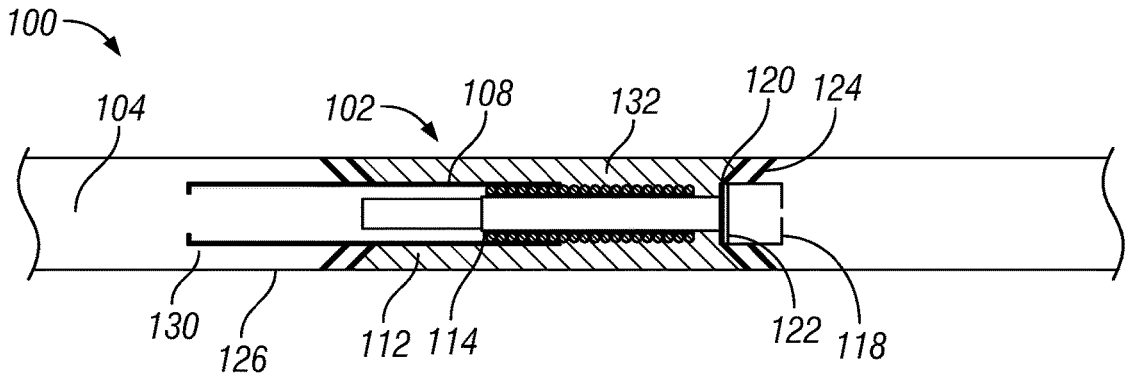
FIG. 3 is a schematic diagram of a cross-section view of the expandable packer of FIG. 1 in a sealing configuration, according to the first embodiment.

The activatable sealing element 102 and expandable packer 100 are shown in FIGS. 1-3 disposed on a wireline 106. The expandable packer 100 may include an adapter kit to connect the activatable sealing element 102 to a downhole power unit 128, for example. The adapter kit can be suited for the activatable sealing element 102 disposed on a conveyance 106, such as a tubular, drill pipe, wireline, slickline, or the like, depending on the envisioned application.

The specific methods of activation are numerous and may vary from what is shown in FIGS. 1-3. Several activation schemes are described below, but these are not necessarily exhaustive. The skilled person in the art will appreciate additional methods of activation other than those described and shown here.

FIG. 2 shows the expandable packer 100 and activatable sealing element 102 in a post-activation configuration. In operation, the downhole power unit 128 repeatedly strokes the expandable packer 100 to set the expandable packer 100 downhole. In addition to setting the expandable packer 100, the strokes of the downhole power unit 128 activate the activatable sealing element 102 to cause the reactive fluid 116 to exit the openable container 118 by any of several mechanisms. Operation of the downhole power unit 128 can trigger unblocking or otherwise opening of the mechanical element 120, allowing the reactive fluid 116 to exit the openable container 118. Alternatively or in conjunction, the downhole power unit 128 can trigger a piston 122 to expel the reactive fluid 116. Alternatively or in conjunction, the downhole power unit 128 can create a suction in the hydrostatic chamber to break the mechanical element 120 in the form of a rupture disk and suck out the reactive fluid 116. After setting the expandable packer 100, the downhole power unit 128 can detach from the expandable packer 100 and be retrieved from the borehole 104.

As shown, the cover sleeve 108 is removable to allow the swellable metal 110 to expand into the annular space 112, which can be accomplished, for example, with the downhole power unit 128. A stroke of the downhole power unit 128 can pull back the cover sleeve 108 relative to the inner sleeve 114. The relative motion exposes the hydrostatic chamber and swellable metal 110 therein to the annular space 112. The hydrostatic chamber can be at pressure lower than the adjacent annular space 112, such as atmospheric pressure, for example. When a pressure differential exists, exposure of the hydrostatic chamber to the annular space 112 creates a suction which causes the reactive fluid 116 in the annular space 112 to flow in and contact the swellable metal 110 to form the swelled metal 132.

After activation, the reactive fluid 116 exits the openable container 118 and contacts the swellable metal 110. The specific method of activation shown in FIG. 2 includes the downhole power unit 128 pulling back the cover sleeve 108, a piston 122 pushing the reactive fluid 116 out of the openable container 118, and the reactive fluid 116 entering the annular space 112 and then entering the hydrostatic chamber. However, as described above, additional activation methods and combinations thereof are possible.

Alternatively, the cover sleeve 108 can be removed with heat optionally produced from the reaction of the reactive fluid 116 and the swellable metal 110, such as where the reaction is exothermic. To allow such removal, the cover sleeve 108 can comprise a degradable or dissolvable material including thermoplastics, metals, alloys, or combinations thereof. The cover sleeve 108 being degradable or dissolvable facilitates its removal without reliance on mechanical, electronic, or other removal mechanisms. In this manner, if such removal mechanisms fail, the degradable or dissolvable cover sleeve 108 thus remains removable. For instance, a thermoplastic cover sleeve 108 can melt and soften after receiving heat by proximity to the exothermic swell reaction, such that expansive force of the swellable metal 110 removes the softened thermoplastic cover sleeve 108. The cover sleeve 108 can alternatively degrade or dissolve upon contact with the reactive fluid 116, such as where the cover sleeve 108 comprises magnesium. The magnesium cover sleeve 108 is preferably less reactive than the swellable metal 110, so that the cover sleeve 108 does not react to degrade until the reaction is sped up by the heat provided by the exothermic swell reaction. Furthermore, where the cover sleeve 108 comprises the same material as the swellable metal 110, the cover sleeve 108 can react and join the swelled metal 132 to expand into the annular space 112. Although potentially removable without reliance on mechanical, electronic, or other removal mechanisms, the cover sleeve 108 however is not removed until activation of the activatable sealing element 102, even when contacted by ionic aqueous fluids flowing through the borehole.

FIG. 3 shows the expandable packer 100 and activatable sealing element 102 in a sealing configuration. Once the reactive fluid 116 contacts the swellable metal 110, the reaction begins and forms the swelled metal 132 having increased volume compared to the swellable metal 110. The wiper plugs 124 direct the expansion of the swelled metal 132 into the annular space 112. The swelled metal 132 expands into sealing engagement with the wall 126, at least partially restricting fluidic communication within the annulus 130.

Figure 4:
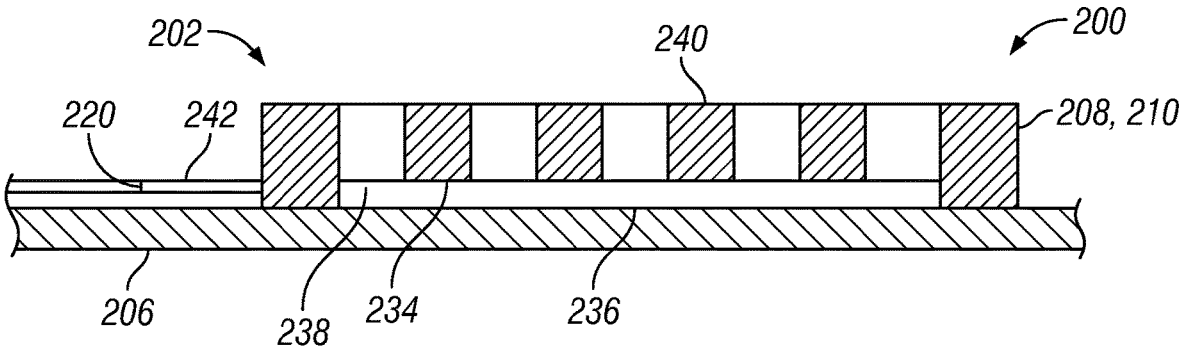
FIG. 4 is a schematic diagram of a cross-section view of an expandable packer comprising an activatable sealing element along a length-wise plane in a pre-activation configuration, according to a second embodiment.
Figure 5:
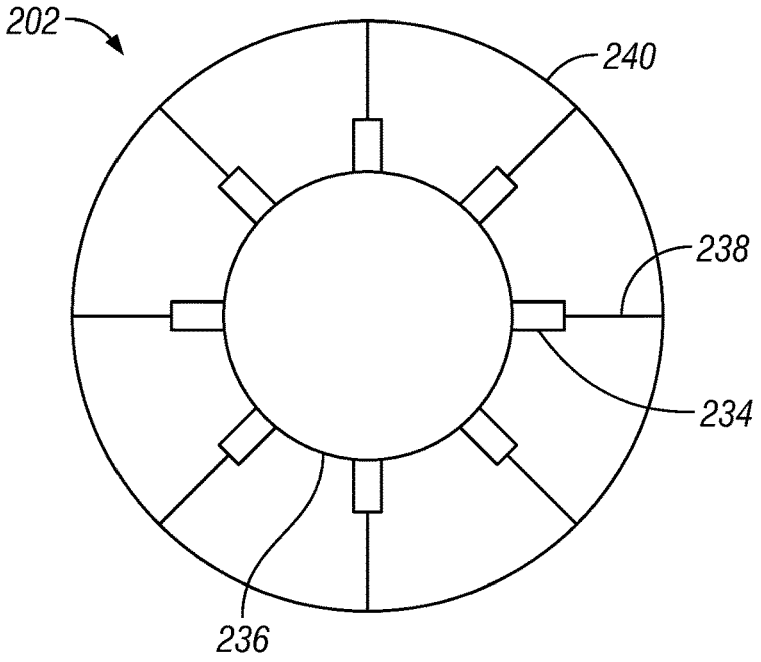
FIG. 5 is a schematic diagram of a cross-section view of the expandable packer of FIG. 4 along a transverse plane in a pre-activation configuration, according to the second embodiment.

FIGS. 4 and 5 show a second embodiment of an expandable packer 200 and activatable sealing element 202 in a pre-activation configuration. The activatable sealing element 202 comprises a sleeve 208 comprising a swellable metal 210. The activatable sealing element 202 is mounted on a tubular 206 as part of the expandable packer 200. A control line 242 with a mechanical element 220 in the form of a valve conveys reactive fluid 216 to the sleeve 208 of the activatable sealing element 202. The mechanical element 220 can be a rupture disk, which is burstable upon activation of the activatable sealing element 202 to allow the reactive fluid 216 to flow through the control line 242. The mechanical element 220 may be located within the control line 242 away from the activatable sealing element 202, or alternatively can be located at or within the sleeve 208. The sleeve 208 also includes grooves 234 running along an inner diameter 236 of the activatable sealing element 202. The grooves 234 include channels 238 extending from the grooves 234 and through the sleeve 208.

Figure 6:
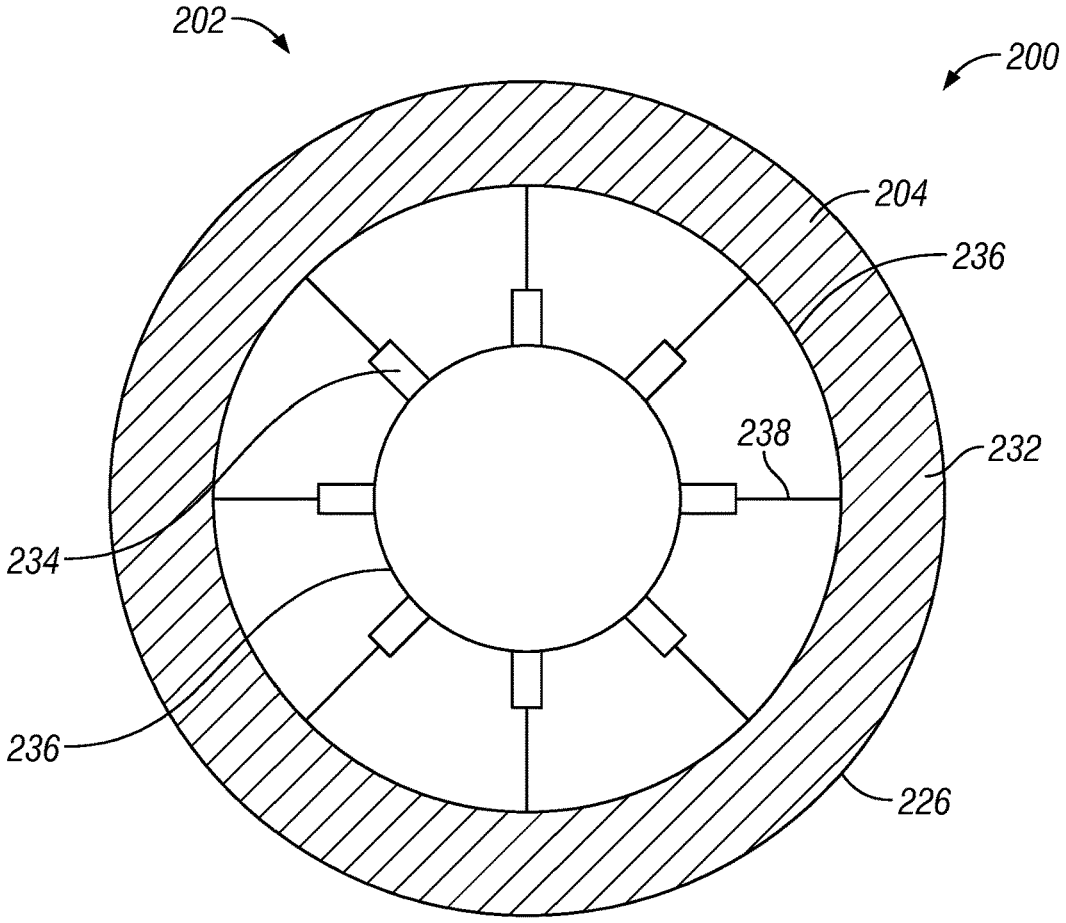
FIG. 6 is a schematic diagram of a cross-section view of the expandable packer of FIG. 4 along a transverse plane in a sealing configuration, according to the second embodiment.
Figure 7:
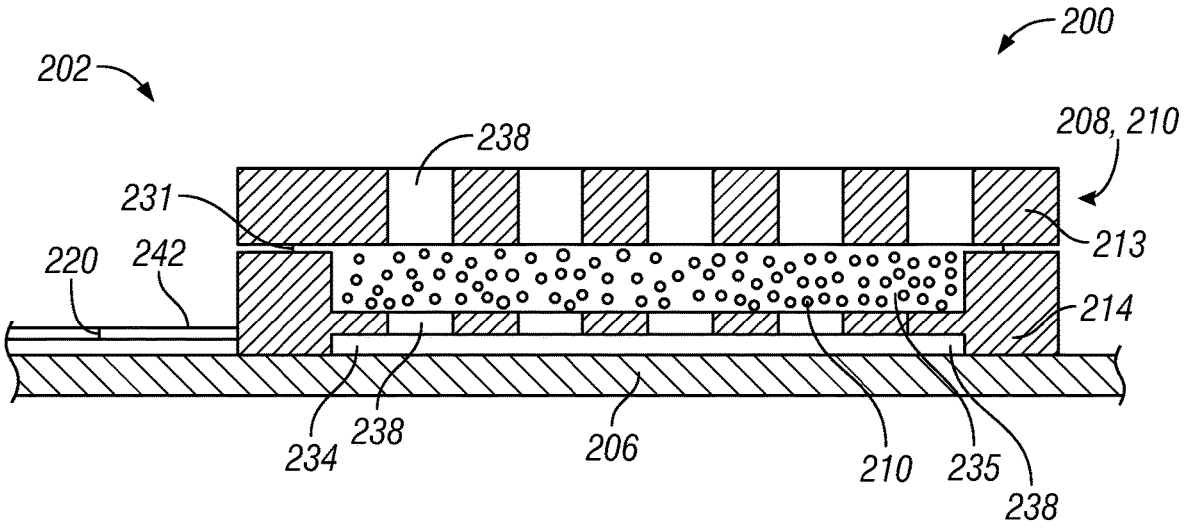
FIG. 7 is a schematic diagram of a cross-section view of an alternative design of the expandable packer of FIG. 4 along a length-wise plane in a pre-activation configuration, according to the second embodiment.

FIG. 6 shows the activatable sealing element 202 in a sealing configuration. Upon activation of the activatable sealing element 202, the mechanical element 220 in the form of a rupture disk is ruptured, allowing the reactive fluid 216 to flow through the control line 242 and into the activatable sealing element 202. Alternatively, the reactive fluid 216 can be contained at the surface and injected via a control line 242. Alternatively, the reactive fluid 216 can be contained in a fluid chamber downhole and pumped with a downhole pump through the control line 242 to the activatable sealing element 202. The skilled person in the art will appreciate additional ways of conveying the reactive fluid 216 to the activatable sealing element 202 not limited to those shown in FIGS. 4-6 or described here. After activation, the reactive fluid 216 flows through the grooves 234, through the channels 238, and outside the sleeve 208. In so doing, the reactive fluid 216 contacts the swellable metal 210 of the sleeve 208 to react with and expand the swellable metal 210 to form swelled metal 232. The swelled metal 232 expands out into the annulus of the borehole 204 and into sealing engagement with the wall 226. Although not shown, wiper plugs can be installed to at least partially seal an annular space and direct expansion of the swellable metal 210.

In addition to the sleeve 208 being swellable metal, FIG. 7 shows an alternative cavity 235 inside the sleeve 208 of the activatable sealing element 202. As shown, the sleeve 208 includes an outer sleeve 213 and an inner sleeve 214 connected and sealed to one another at a connection 231, such as by threaded connection. The outer sleeve 213 and the inner sleeve form a circumferential cavity 235 between the inner sleeve 214 and the outer sleeve 208 where additional swellable metal 210 can be located. The additional swellable metal 210 may be the same metal as the sleeve 208 or may be a different metal to control the rate of expansion upon reaction with the reactive fluid 216. The additional swellable metal 210 is show as being in the form of wires wrapped circumferentially around the inner sleeve 214 but the additional swellable metal 210 may be in any suitable form. Reactive fluid 216 flowing into the inner sleeve 214 flows through the grooves 234, into the channels 238, and then disperses through the cavity 235 to contact and react with the additional the swellable metal 210. After reaction with the reactive fluid 216, the swellable metal 210 of the sleeve 208 and in the cavity 235 expands to form swelled metal 232. The swelled metal 232 expands out into the annulus of the borehole 204 and into sealing engagement with the wall 226.

Figure 8:
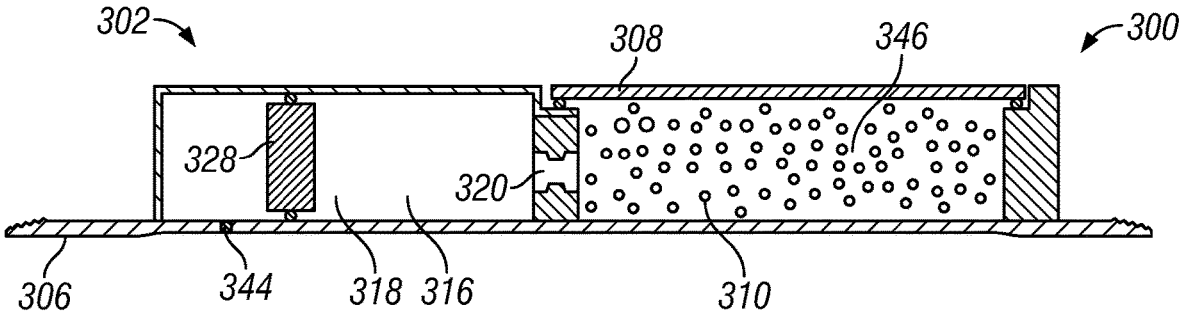
FIG. 8 is a schematic diagram of a cross-section view of an expandable packer comprising an activatable sealing element in a pre-activation configuration, according to a third embodiment.

FIG. 8 shows a third embodiment of an expandable packer 300 and activatable sealing element 302 in a pre-activation configuration. The activatable sealing element 302 comprises a fluid chamber 318 containing the reactive fluid 316. The activatable sealing element 302 also comprises a chamber 346 containing the swellable metal 310. The chamber 346 may be a hydrostatic chamber.

A mechanical element 320 in the form of a valve is positioned between and separates the fluid chamber 318 and the chamber 346. Before activation of the activatable sealing element 302, the mechanical element 320 separates the reactive fluid 316 from the swellable metal 310. The mechanical element 320 can comprise any openable valve for temporarily preventing fluid flow, such as an isolation valve, a regulator valve, a relief valve, a rupture disk, a port, a flow restrictor, or a combination thereof, such as a rupture disk and flow restrictor in series, for example.

The activatable sealing element 302 further includes a piston 328 located within the fluid chamber 318 that seals off the reactive fluid 316 on one side of the piston 328. The piston 328 is operable or movable within the fluid chamber 318 to cause the reactive fluid 316 to flow through the mechanical element 320 and contact the swellable metal 310.

The activatable sealing element 302 also comprises a cover sleeve 308, which protects the swellable metal 310 and is removable to allow the swellable metal 310 to swell from contact with the reactive fluid 316 and expand out from the activatable element 302 into sealing engagement with the wall 326 similarly to the cover sleeve 108 discussed above in FIGS. 1-3.

The fluid chamber 318 and the chamber 346 surround a tubular 306 or mandrel 306 that comprises a port 344. The port 344 allows communication of pressure from inside the tubular 306 into the fluid chamber 318. The pressure moves the piston 328 to push the reactive fluid 316 through the mechanical element 320 and into the chamber 346 to contact the swellable metal 310.

Figure 9:
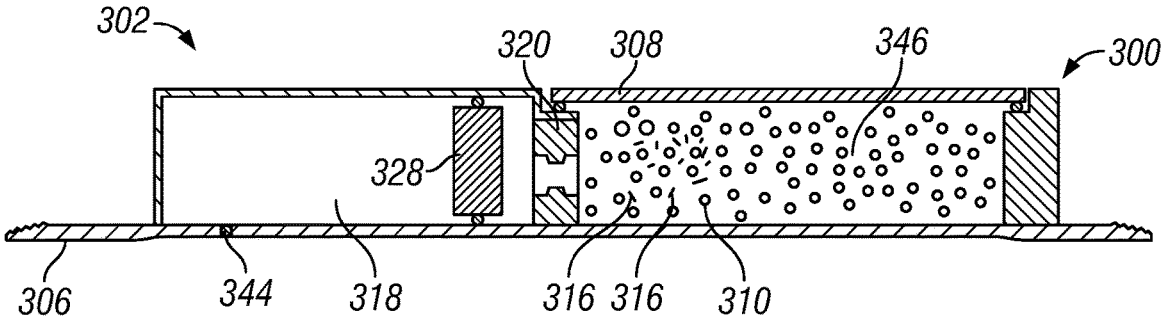
FIG. 9 is a schematic diagram of a cross-section view of the expandable packer of FIG. 8 in a post-activation configuration, according to the third embodiment.

FIG. 9 shows the activatable sealing element 302 in a post-activation configuration. Injection of pressurized fluid into the tubular 306 is communicated to the fluid chamber 318 through the port 344 to move the piston 328 to activate the activatable sealing element 302. After activation of the activatable sealing element 302 via communication of pressure through the port 344, the piston 328 pushes the reactive fluid 316 into contact with the swellable metal 310. The reactive fluid 316 contacting the swellable metal 310 reacts with and expands the swellable metal 310 to form swelled metal 332.

Figure 10:
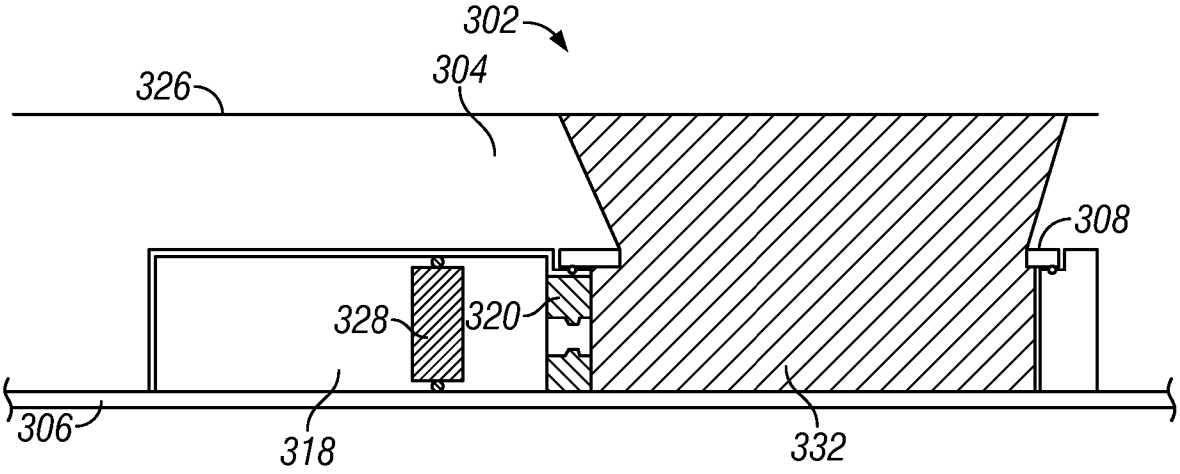
FIG. 10 is a schematic diagram of a cross-section view of the expandable packer of FIG. 8 in a sealing configuration, according to the third embodiment.

FIG. 10 shows the activatable sealing element 302 in a sealing configuration. The cover sleeve 308 is removed or joined with the swelled metal 332 as described above with respect to the cover 108 shown in FIGS. 1-3, allowing the swelled metal 332 to expand away from the activatable sealing element 302 into the borehole 304 and contact the wall 326 to form the seal.

Figure 11:
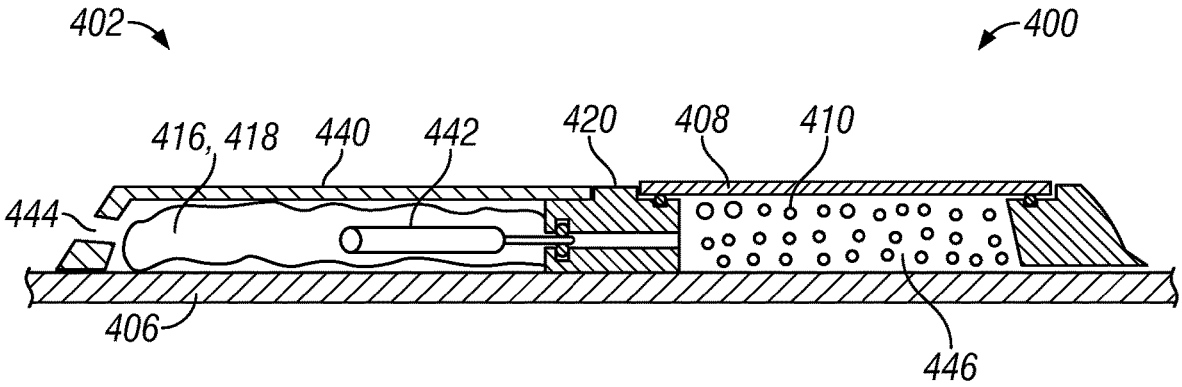
FIG. 11 is a schematic diagram of a cross-section view of an expandable packer comprising an activatable sealing element in a pre-activation configuration, according to a fourth third embodiment.
Figure 12:
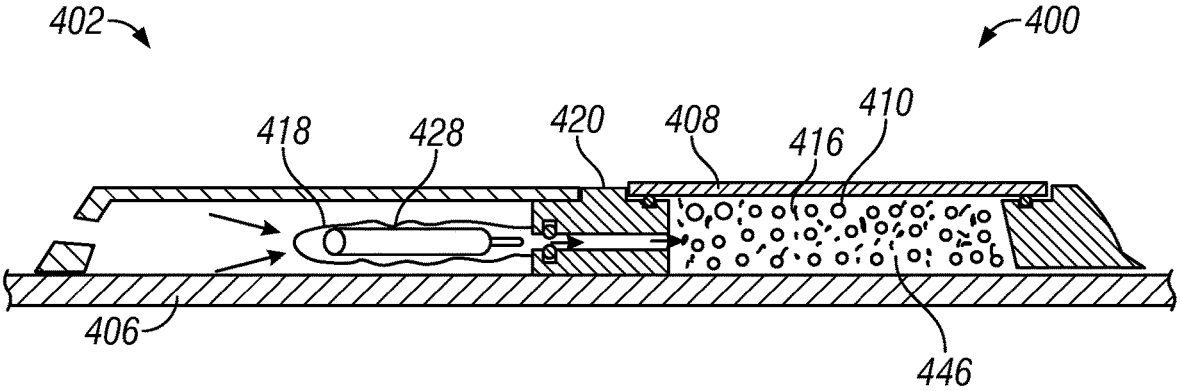
FIG. 12 is a schematic diagram of a cross-section view of the expandable packer of FIG. 11 in a post-activation configuration, according to the fourth embodiment.

FIG. 11 shows a fourth embodiment of an expandable packer 400 and activatable sealing element 402 in a pre-activation configuration. The expandable packer 400 surrounds a tubular 406 or mandrel 406. Similar to the activatable sealing element 302, the activatable sealing element 402 includes a fluid chamber 418 containing a reactive fluid 416. The fluid chamber 418 can be a flexible container or bag that collapses when depressurized. The fluid chamber 418 is located within a housing 440 that includes a port 444 open to communicate pressure from the borehole outside the expandable packer 400. The activatable sealing element 402 also comprises a chamber 446 containing the swellable metal 410. The chamber 446 may be a hydrostatic chamber.

A mechanical element 420 in the form of a valve is positioned between and separates the fluid chamber 418 and the chamber 446. Before activation of the activatable sealing element 342, the mechanical element 420 separates the reactive fluid 416 from the swellable metal 410. The mechanical element 420 can comprise any openable valve for temporarily preventing fluid flow, such as an isolation valve, a regulator valve, a relief valve, a rupture disk, a port, a flow restrictor, or a combination thereof, such as a rupture disk and flow restrictor in series, for example.

A firing pin 440 blocks flow of the reactive fluid 416 through the mechanical element 420. The firing pin 440 is activated by timer, pressure signal, vibration signal, or temperature change. Upon receipt of an activation signal, small explosives within the firing pin 440 discharge, which dislodge the firing pin 440 from the mechanical element 420, opening the flow path through the mechanical element 420 to the swellable metal 410 in the chamber 446.

The activatable sealing element 402 also comprises a cover sleeve 408, which protects the swellable metal 410 and is removable to allow the swellable metal 410 to swell from contact with the reactive fluid 416 and expand out from the activatable element 402 into sealing engagement with a wall in the borehole similarly to the cover sleeve 108 discussed above in FIGS. 1-3.

FIG. 12 shows the activatable sealing element 302 in a post-activation configuration. The firing pin 442 has discharged and been removed from the mechanical element 420, thus opening the mechanical element 420. With the mechanical element 420 open, the pressure from outside the expandable packer 400 that is communicated to the fluid chamber 418 through the port 444 collapses the fluid chamber 418, thus pushing the reactive fluid 416 into the chamber 446 to contact the swellable metal 410. The reactive fluid 416 contacting the swellable metal 410 reacts with and expands the swellable metal 410 to form swelled metal. The cover sleeve 408 is removed or joined with the swelled metal as described above with respect to the cover 108 shown in FIGS. 1-3, allowing the swelled metal to expand away from the activatable sealing element 402 into the borehole and contact a wall in the borehole to form a seal.

Examples of the above embodiments include the following numbered examples where the embodiments of any subsequent example incorporate the embodiment(s) of any preceding example(s) or combinations thereof:

1. An expandable packer comprising an activatable sealing element disposable in a borehole having a wall and activatable with a reactive fluid, the sealing element comprising:
   - a swellable metal capable of reacting with the reactive fluid to form a swelled metal; and
   - a mechanical element separating the reactive fluid from the swellable metal and operable to cause the reactive fluid to contact the swellable metal such that swellable metal expands into sealing engagement with the wall.

2. The expandable packer of example 1, further comprising a cover sleeve separating the swellable metal from an annular space surrounding the cover sleeve, wherein the mechanical element is selectively operable to remove the cover sleeve to expose the swellable metal to the annular space.

3. The expandable packer of example 2, wherein the swellable metal is contained within a hydrostatic chamber.

4. The expandable packer of example 3, further comprising an openable container containing the reactive fluid, the openable container being openable by operation of the mechanical element.

5. The expandable packer of example 4, further comprising wiper plugs positioned between the cover sleeve and the wall and between the openable container and the wall to at least partially seal the annular space.

6. The expandable packer of example 4, wherein the openable container comprises a piston to push the reactive fluid into the annular space and a valve separating the openable container from the annular space.

7. The expandable packer of example 1, wherein the swellable metal comprises a sleeve with a longitudinal groove positioned to convey the reactive fluid to the sleeve and channels perforating the groove and the sleeve to allow the reactive fluid to flow through and contact the swellable metal.

8. The expandable packer of example 7, wherein the mechanical element comprises a control line arranged to convey the reactive fluid to the activatable sealing element.

9. The expandable packer of example 7, wherein the reactive fluid is contained outside the activatable sealing element and is injectable into the activatable sealing element.

10. The expandable packer of example 1, further comprising:
   - a fluid chamber containing the reactive fluid;
   - a hydrostatic chamber containing the swellable metal;
   - a valve positioned between and separating the fluid chamber and the hydrostatic chamber and movable to cause the reactive fluid to flow through the valve and contact the swellable metal; and
   - a cover sleeve removable to allow the swellable metal to swell from contact with the reactive fluid.

11. The expandable packer of example 10, wherein the fluid chamber and the hydrostatic chamber surround a tubular that comprises a port that allows communication of pressure from inside the tubular to move the mechanical element.

12. The expandable packer of example 10, wherein the mechanical element comprises a piston movable to push the reactive fluid through the valve to contact the swellable metal.

13. The expandable packer of example 10, wherein the mechanical element comprises a firing pin blocking the valve and movable to collapse the fluid chamber and force the reactive fluid through the valve to contact the swellable metal.

14. The expandable packer of example 13, wherein the firing pin is activated by timer, pressure signal, vibration signal, or temperature change.

15. The expandable packer of example 1, wherein the swellable metal is in the form of beads, wires, pellets, powder, particles, granules, or a combination thereof.

16. The expandable packer of example 1, wherein the reactive fluid is deliverable to the activatable sealing element via a control line.

17. A method of forming a seal in a borehole comprising a wall, the method comprising:

locating an expandable packer comprising an activatable sealing element within the borehole;

using a mechanical element of the activatable sealing element to cause a reactive fluid to contact a swellable metal; and expanding the swellable metal into sealing engagement with the wall by reacting the swellable metal with the reactive fluid.

18. The method of example 17, wherein the contact produces hydrogen gas and the method further comprises venting the hydrogen gas through wiper plugs positioned between the activatable sealing element and the wall.

19. The method of example 17, wherein the reactive fluid does not contact the swellable metal without operation of the mechanical element.

20. The method of example 17, wherein using the mechanical element further comprises opening an openable container containing the reactive fluid.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While compositions and methods are described herein in terms of "comprising" various components or steps, the compositions and methods can also "consist essentially of" or "consist of" the various components and steps.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques accepted by those skilled in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. An expandable packer locatable in a borehole having a borehole wall, the expandable packer comprising:

an activatable sealing element comprising:

at least one of a swellable metal or a swellable metal alloy having a first volume and capable of hydrolyzing when reacted with a reactive fluid to form a reaction product comprising a swelled metal hydroxide or swelled metal oxide that is insoluble in water and having a second volume greater than the first volume;

an openable container housing the reactive fluid;

a mechanical element comprising at least one of a piston, a gate, a port, a valve, or a rupture disk separating the reactive fluid from the activatable sealing element and operable to open the openable container and cause the reactive fluid to contact the activatable sealing element such that the activatable sealing element reacts with the reactive fluid to form the reaction product, the second volume of which is sufficient to place the reaction product into sealing engagement with the borehole wall;

a cover sleeve separating the swellable metal from an annular space surrounding the cover sleeve, wherein the cover sleeve is selectively removable to expose the swellable metal to the annular space; and wiper plugs positioned between the cover sleeve and the borehole wall and between the openable container and the borehole wall to at least partially seal the annular space, wherein the contact between the reactive fluid and activatable sealing element produces hydrogen gas, and wherein the wiper plugs are configured to allow at least some of the hydrogen gas to vent through the wiper plugs.

2. The expandable packer of claim 1, wherein the swellable metal includes an alkaline earth metal, a transition metal, a post-transition metal, or a combination thereof.

3. The expandable packer of claim 1, wherein the swellable metal includes, or the swellable metal alloy includes an alloy including, magnesium, calcium, aluminum, or combinations thereof.

4. The expandable packer of claim 1, wherein the swellable metal is contained within a hydrostatic chamber.

5. The expandable packer of claim 4, further comprising the openable container being openable by operation of a downhole power unit.

6. The expandable packer of claim 1, wherein the swellable metal is in the form of beads, wires, pellets, powder, particles, granules, or a combination thereof.

7. A method of forming a seal in a borehole comprising a wall, the method comprising:

locating an expandable packer comprising an activatable sealing element comprising at least one of a swellable metal or a swellable metal alloy having a first volume, a reactive fluid contained in an openable container, and a mechanical element within the borehole;

operating the mechanical element comprising at least one of a piston, a gate, a port, a valve, or a rupture disk to open the openable container and cause the reactive fluid to contact and react with the activatable sealing element to hydrolyze the swellable metal to form a reaction product comprising a swelled metal hydroxide or swelled metal oxide that is insoluble in water;

expanding the reaction product into sealing engagement with the wall to form a seal;

producing hydrogen gas from the contact between the reactive fluid and activatable sealing element; and venting at least some of the hydrogen gas through wiper plugs positioned between the activatable sealing elements and the wall.

8. The method of claim 7, wherein the reactive fluid does not contact the swellable metal without operation of the mechanical element.

9. The method of claim 7, wherein the swellable metal includes an alkaline earth metal, a transition metal, a post-transition metal, or a combination thereof.

10. The method of claim 7, wherein the swellable metal includes, or the swellable metal alloy includes an alloy including, magnesium, calcium, aluminum, or combinations thereof.

* * * * *